United States Patent [19]

Stoll

[11] Patent Number: 4,750,408

[45] Date of Patent: Jun. 14, 1988

[54] ADVANCING DEVICE

[76] Inventor: Kurt Stoll, Lenzhalde 72, 7300 Esslingen, Fed. Rep. of Germany

[21] Appl. No.: 888,739

[22] Filed: Jul. 21, 1986

[30] Foreign Application Priority Data

Jul. 30, 1985 [DE] Fed. Rep. of Germany ..... 3527155

[51] Int. Cl.[4] ..... F15B 15/17; F15B 13/042

[52] U.S. Cl. ..... 92/51; 92/107; 92/110; 92/165 PR; 91/418

[58] Field of Search ..... 92/51, 52, 107, 108, 92/110, 165 PR; 91/418

[56] References Cited

U.S. PATENT DOCUMENTS

| | | | |
|---|---|---|---|
| 3,045,649 | 7/1962 | Blatt | 92/110 |
| 3,335,642 | 8/1967 | Roasen | 92/110 |
| 3,592,108 | 7/1971 | Roasen et al. | 92/52 |
| 3,610,100 | 10/1971 | Hoffman | 92/108 |
| 3,622,124 | 11/1971 | Sidles et al. | 92/108 |
| 3,858,485 | 1/1975 | Roasen et al. | 92/108 |
| 3,945,300 | 3/1976 | Bourges | 92/52 |
| 4,130,205 | 12/1978 | Lüthi | 92/165 PR |

FOREIGN PATENT DOCUMENTS

| | | | |
|---|---|---|---|
| 2456268 | 1/1981 | France | 92/165 PR |

*Primary Examiner*—George L. Walton
*Attorney, Agent, or Firm*—McGlew and Tuttle

[57] ABSTRACT

The invention relates to an advancing or feed for moving a workpiece on a machine tool. The device comprises a stationarily arranged fluid power cylinder whose piston rod extending through one of the end caps of the cylinder is connected with a load driving member or carriage for carrying the workpiece. The outer face of the cylinder has at least two, generally diametrally opposite guide flats on which two flat bearer faces in the driving member run so as to preclude rotation if the driving member about the cylinder.

17 Claims, 2 Drawing Sheets

ADVANCING DEVICE

BACKGROUND OF THE INVENTION

The invention relates to an advancing device with a fluid power piston and cylinder arrangement comprising a stationarily mounted cylinder whose two ends are closed by cylinder end caps, a piston arranged for motion in the longitudinal direction of the cylinder, a piston rod connected with the piston and extending sealingly through one of the end caps, a load driving member mounted on a section of the piston rod located outside the cylinder and adapted to perform a linear advancing motion on operation of the piston and cylinder arrangement, and a guide for guiding motion of the load.

Advancing devices of this type are used in the mechanical engineering field, as for example in a machine tool, to shift a workpiece into a desired position in which it is to be machined. In such a case the load drive member will be in the form of a machine carriage, which is mounted on the piston rod to form an axial extension thereof. The topside of the load driving member is designed as the carriage that it is able to carry the work. The opposite, lower side of the machine carriage runs in a guide, which simultaneously forms a plain bearing designed to carry the mass of the work. By suitable operation of the piston and cylinder arrangement, it is possible to move the work along in the longitudinal direction of the cylinder and to position it in any desired setting as required. Further possible applications of the above mentioned advancing device are conceivable, as for instance in which the load driving part is in the form of a plunger shaped to meet the requirements of a given case. All known advancing devices have the shortcoming that they are relatively long when measured in the direction of advance so that the machines equipped with them will also be relatively long. The long overall length is due to the placement of the piston and cylinder arrangement and the load driving part along a single axis, i.e. without overlap. This manner of construction furthermore involves a slow assembly of the advancing device which needs frequent adjustment. Since in fact the guide of the load driving member necessarily has to be mounted on the machine frame, exact adjustment of the advancing device is required in order to ensure satisfactory sliding of the load drive member on the guide. This obviously involves high assembly or fitting costs. Last but not least, the production of the guide for the load driving member is complex, and the fitting of the guide to suit the geometry of the load driving member and that of the machine tool to have with the advancing device is always a slow job. In fact, different types of machine require different designs of the guide. This is more particularly a disadvantage in the production of customized or special purpose machines, which are generally produced in one unit at a time with a unique design of the load driving member and the guide therefor.

GENERAL OUTLINE OF THE INVENTION

One object of the present invention is to devise an advancing device of the initially mentioned type which guarantees an optimum of the load driving member and may be employed without any specialized fitting operation.

A further aim of the invention is to provide such an advancing device which is of universal application and is of a simple design, more particularly as regards the guide.

A still further objective of the invention is to design such an advancing device which is both compact and simple to fit.

In order to achieve these or other objects appearing in the course of the present specification and claims, in accordance with the invention on the outer periphery of the cylinder there are at least two guide surfaces which are generally opposite and plane-parallel to each other, extend in the longitudinal direction of the cylinder and are fixed longitudinally and rotationally in relation to the cylinder, the load driving member has at least two bearer faces placed so as to be opposite and parallel to the respective guide surfaces and in each case one of the respective bearer surfaces slidingly engages the associated guide surface for motion in the longitudinal direction of the cylinder in such a way that is not possible for it to be turned around the longitudinal axis of the cylinder. It will consequently be seen that the piston and cylinder arrangement is itself responsible for guiding the load driving member, for which reason it is not necessary to have a separate guiding means. This simplifies the fitting of the advancing device to a machine very substantially, inasfar as no adjusting operations will be needed on the guide. The adjustment of the load driving member to suit the guide is something that takes place directly during manufacture and assembly of the advancing device itself. In consequence, the advancing device of the invention is universally applicable and independent of the type of machine to be equipped therewith it will always be possible to use the same type of advancing device or guide respectively. At the same time the guiding of the load driving member takes place very much more accurately, since an adaptation of the bearer and guide surfaces to match each other may take place directly during the manufacture of the advancing device. In this respect, it is naturally possible to keep to substantially tighter limits of accuracy than in the case of a prior art design of the sort specified above. A further advantage of the advancing device of the present invention is to be seen in the not insubstantial economies in material, since the guide surfaces are able to be produced directly on the cylinder itself. It will furthermore be clear that the advancing device of the invention has a more compact overall size, since the guiding of the load driving member takes place adjacent to the load and it not placed in front of or behind it. It is thus possible to make a substantial reduction in the overall length of the load driving part projecting out past the piston rod when it is in the retracted position. This is something which in turn allows the user to make a reduction in the overall volume of the machine to be equipped with the advancing device. Since the load driving member is guided at diametrally opposite positions, buckling of the advancing device will be precluded even when the the piston rod has been driven a relatively long distance out of the interior of the cylinder and when there is a simultaneous loading by transverse forces. A further advantage is to be envisaged in the fact that the advancing device of the invention has flat guide and bearer surfaces with large areas engaging each other which at the same time function to prevent mutual rotation so that no separate measures are necessary in this respect.

Further features of the invention are defined in the claims.

In accordance with one further feature of the invention the length of the load driving member as measured in the longitudinal direction of the cylinder is at the most approximately equal to the length of the cylinder with its end caps, and in the retracted condition of the piston rod is generally opposite to the outer periphery of the cylinder radially so that the length of the complete advancing device is approximately equal to the length of the cylinder. This form of the invention ensures a compact overall length of the novel advancing device. It is an advantage if in the retracted condition of the piston rod the overall length of the device is not greater than approximately the length of the cylinder itself.

In accordance with further features of the invention the load driving member possesses a driving face (which is more particularly flat) on which an object, such as a piece of work to be shifted, may be secured and which is opposite to one of the bearer surfaces so that in relation to same it is remote from the cylinder and faces away from the latter. Furthermore, the driving surface, which is preferably made parallel to the opposite bearer surface is placed generally between the cylinder caps when viewed from the side and in the retracted condition of the piston rod and it is furthermore placed so as to be opposite to the associated guide surface. These further developments of the invention ensure a larger range of displacement of the driving surface while at the same time having compact dimensions of the advancing device. The force due to the weight of a piece of work that is to be displaced is taken up by the guide surface of the cylinder which is directly opposite, whereas the diametrally opposite pairs of cooperating surface resist any bending forces occurring on moving the piston rod out of the cylinder. In accordance with a further feature of the invention the load driving member may have generally the form of a channel with the opening of the channel facing in the longitudinal direction of the cylinder and being turned towards the cylinder so that dependent on the position of the piston rod joined with the transverse web of the channel the cylinder is inserted into the opening of the channel and the two bearer surfaces are on opposite, facing inner sides of the flanges of the channel or are formed thereby. This further feature of the invention makes an additional contribution to resisting bending forces and constitutes a particularly simple form of the load driving member.

It is furthermore possible for the load driving member to have a generally bell-shaped load driving carriage with a square cross section and a carriage end wall centrally secured to the piston rod, the opening of the end wall being directed in the longitudinal direction of the cylinder and facing the cylinder, which, dependent on the position of the piston rod, extends to a greater or lesser extent into the opening, the bearer surfaces being arranged on the inner sides of two mutually opposite walls of the carriage. This further feature of the invention involves a compact design while at the same time safeguarding the piston and cylinder arrangement functioning as a drive, since the same is largely enclosed within the bell-like load driving carriage.

In accord with a further feature of the invention on the inner sides of the relatively opposite third and fourth side walls, not constituting bearer surfaces, of the load driving carriages there is a respective flat abutment surface extending in the length direction of the cylinder and such surfaces running on matching diametrally opposite lateral guide surfaces on the outer periphery of the cylinder and the bearer surfaces are at a right angle to the abutment surfaces and the guide surfaces are at a right angle to the lateral guide surfaces. Furthermore the bearer surfaces and the guide surfaces and the lateral guide surfaces may be arranged in the form of a square or other rectangle and so as to be transverse in relation to the length direction of the surfaces and in the length directio of the cylinder, and the bearer and abutment surfaces surround the guide and lateral guide surfaces coaxially and with a running fit. This further feature of the invention provides in addition a lateral guiding effect for the load driving member so that the accuracy of its guiding effect is further enhanced. This form of the invention is more especially advantageous if additional lateral forces act on the load driving member.

The advancing device of the invention may in addition be so designed that the bearer surfaces and possibly the abutment surfaces extend over the full length of the limbs of the channel or the side walls, respectively, of the bell-like load driving carriage, whose length is approximately the same as the length of the cylinder and or the guide surfaces and possibly the lateral guide surfaces extend approximately along the full length of the cylinder. This further feature of the invention allows an optimum distribution of any force resulting from the weight of the workpiece. At the same time a large area of engaging surfaces is ensured in every position of the load driving member.

In order to provide for a simple geometry of the load driving member, the driving surface is provided on the side of one of the channel limbs, or a side wall of the load driving carriage which is turned away from the cylinder.

It is possible for the guide surfaces and the lateral guide surfaces, if present, to be formed directly by the top outer surface of the side walls of the cylinder which has a square or other rectangular outline. This form of the invention ensures that there is only a small number of components and that the load driving member is accurately guided. The use of a cylinder with a square or other rectangular outline and with a cylindrical bore offers the advantage of being able to utilize low-price, standard pistons. As part of a further development of the invention, the guide surfaces or lateral guide surfaces are formed as the radially outwardly turned surfaces of liner plates placed between the cylinder wall and the bearer and abutment surfaces (if present), such liner plates being connected with the cylinder so that they may not be twisted in relation thereto. The cylinder may have a square or other rectangular outline with each of the four outer side faces being placed opposite one of the bearer surfaces and (if present) abutment surfaces. The liner plates may take the form of a preferably integral square or other rectangular tube which is coaxially locked on the cylinder which has a matching outline so that the tube may not be twisted on the cylinder, and is surrounded by the load driving member or load driving carriage so that it is coaxially keyed within it and may be moved longitudinally in relation thereto. That is to say, it is possible either for the liner plates to placed between the plane outer surfaces of the cylinder and the bearer and abutment surfaces (if present), or, more simply, to have a liner body with a square or other rectangular liner member on the cylinder. This will ensure a steady guiding action on all sides of the load driving member.

In order to provide a convenient form of supply of compressed air to the working spaces separated by the piston, such two spaces in the cylinder may each have a duct opening into it and the other end of each duct is connected via a connection orifice an outside compressed air line, such connection ports being placed in the cylinder end cap without any piston rod hole therein and the duct to the first connection orifice opens directly into the working space remote from the piston rod, whereas the duct leading to the second orifice opening into the working space with the piston rod therein is formed by a duct system. This duct system may take the form of a tube extending coaxially in relation to the cylinder and running longitudinally through at least part of the cylinder. This duct system opens at one end at the second connection orifice and at the other end extends into a socket in the form of a blind hole in the piston and the piston rod from the side adjacent to the connection orifices, such socket being connected by way of a transverse hole running through the wall of the piston rod adjacent to the piston, with the cylinder working space space on the piston rod side of the piston. The length of the tube may be generally the same as that of the cylinder and the length of the socket may be somewhat larger, the tube extending to a greater or less extent into the socket in accordance with the position of the piston and piston rod. This development of the invention constitutes an advantageous way of supplying compressed air to the different working spaces in the cylinder. It is more especially the working space with the piston rod therein that may be put under pressure and evacuated if the load driving member has the form of a bell so as to surround the cylinder on all sides so that conventional supply and evacuation of the compressed air would not be possible by conventional means.

The invention will now be described in more detail having reference to the accompanying drawing which shows one working embodiment thereof.

LIST OF THE SEVERAL VIEWS OF THE DRAWINGS

DETAILED ACCOUNT OF WORKING EXAMPLE OF THE INVENTION

Figure 1:
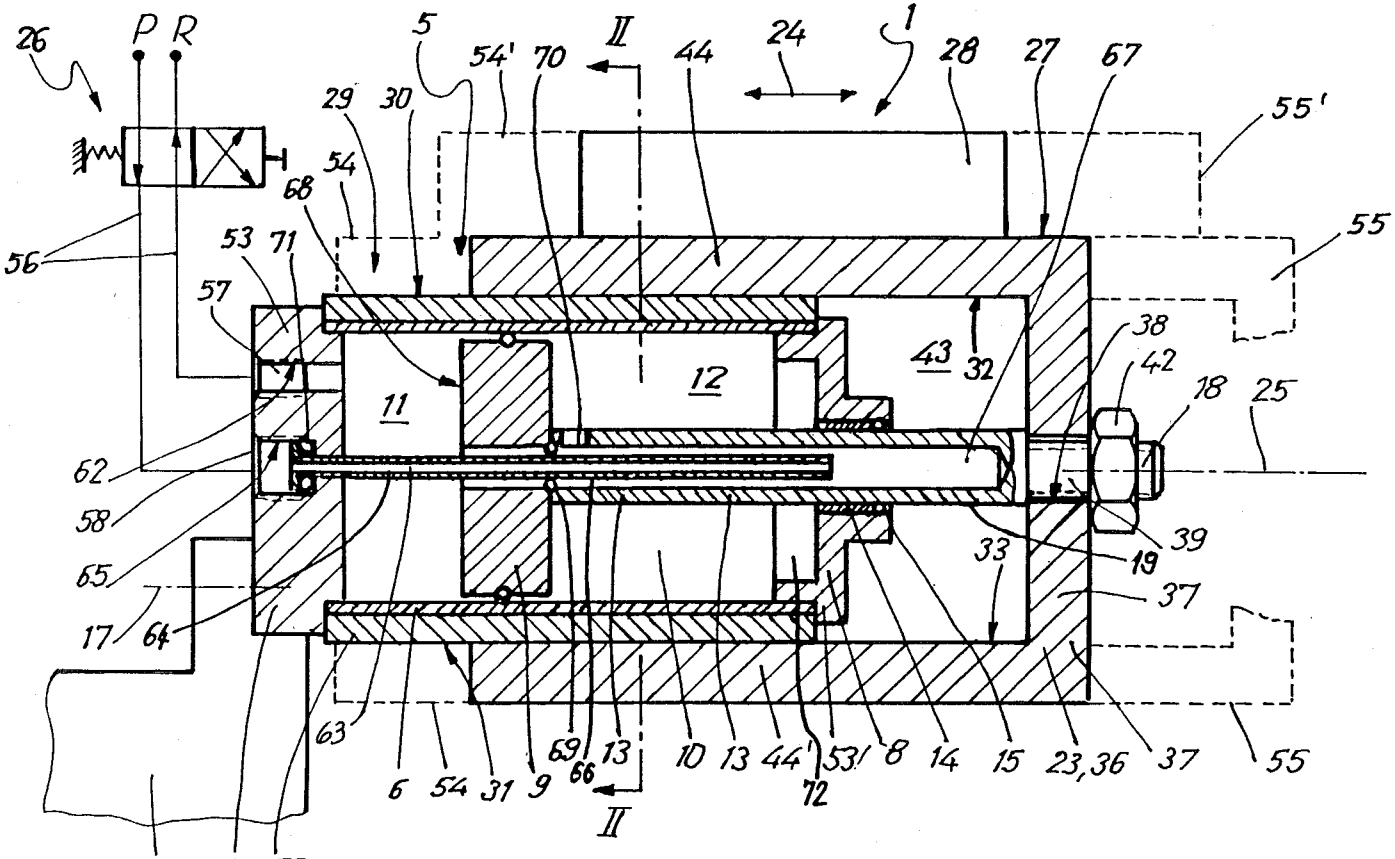
FIG. 1 is a longitudinal section taken through the advancing device of the invention with its operating device indicated diagrammatically.

The advancing device 1 in keeping with the present invention is driven by a fluid power (pneumatic or hydraulic) piston and cylinder arrangement 5, which possesses a cylinder 6 whose two ends are closed by respective end caps 7 and 8. In the interior of the cylinder there is a piston 9 fluid-tightly engaging the cylinder bore and able to be moved in the longitudinal direction of the cylinder. This piston divides interior 10 of the cylinder into two working of piston spaces 11 and 12. A piston rod 13 is permanently joined to the piston 9 coaxially an runs through a packing in the center of one (8) of the cylinder end caps. The piston rod 13 is supported by means of a bushing 14 placed coaxially around it and mounted in the through hole in the cylinder end cap 8. There is a shaft seal ring 15, only indicated diagrammatically engaging the piston rod. The cylinder 6 is detachably mounted by way of the opposite cylinder end cap 7 on a machine part 16 which again is only diagrammatically indicated, such connection being for example by way of screw means indicated at 17. On the free end 18 of the piston rod section 19 protruding out of the cylinder a load driving member 23 is detachably screwed, and when the piston 9 is displaced, such member moves in translation as indicated by the arrow 24 in the length direction 25 of the cylinder 6. The motion of the piston 9 is produced by the putting under pressure and evacuation of the two working spaces 11 and 12 under the control of the operating device 26 which in the present working example of the invention is in the form of a 4/2 way valve. A more detailed account of the supply of the driving fluid in the piston and cylinder arrangement 5 will be given later.

FIG. 1 shows the advancing device 1 mounted in a level position. There is a mounting surface 27 on the upwardly facing top side of the load driving member 23 so that a workpiece 28, indicated diagrammatically, may be mounted thereon in some suitable manner not illustrated here. The workpiece is to be moved into a number of different positions by shifting the load driving member 23; this function is frequently required in machine tools, for which reason the advancing device of the invention is more particularly to be utilized in connection with such machinery. In order to make possible the most accurate advancing motion guides are needed, as will be described in the course of the following account.

On the outer periphery 29 of the cylinder 6, that is to say as part of its outer surface there are two diametrally opposite, flat guide surfaces 30 and 31, which extend parallel to the length direction 25 of the cylinder and are plane-parallel to each other. They constitute means by which the cylinder 6 may perform a longitudinal guiding action. They are at a right angle to a radius extending from the longitudinal axis 25. Furthermore the load driving member 23 is provided with two plane-parallel bearer surfaces 32 and 33, of which each is arranged facing one of the guide surfaces 30 and 31, to which it is parallel. This distance apart of the two bearer surfaces is approximately equal to the distance between the two guide surfaces 30 and 31 so the respectively associated or paired guide and bearer surfaces 30 and 32; 31 and 33 have a running fit. Accordingly a displacement of the load driving member 23 in relation to the cylinder 6 is possible, parallel to the plane of the guide and bearer surfaces, such displacement however being limited to the length of the cylinder 6 owing to the connection between the load driving member 23 and the piston rod 13. Owing to the large area of engagement between the load driving member 23 and its bearer surfaces on the guide surfaces 30 and 31, there is at the same time an effect precluding twisting of the load driving member about its axis, since the guide surfaces, as we have already seen, are provided on the stationary cylinder 6 as means preventing twisting. There is therefore the advantage of the twin function of matching surfaces 30 to 33 with a small number of components and a very simple mechanical design.

In line with a compact manner of construction, the load driving member 23 is in the form of a bell or cup so that in longitudinal section it has the form of a letter U. The longitudinal axis of this load driving member 23, which henceforth will be termed the load driving carriage 36. The open end of the carriage 36 is on the left end of the cylinder and the latter is within it. The end wall 37, opposite to the open side, that is to say the transverse wall of the member with the U-like longitudinal section, is firmly joined to the section 19 of the piston rod. To make this possible the end wall 37 is provided with a central axial hole 38, so that the wall may be slipped over the threaded section 39 at the free end 18 of the piston rod 13 and then be clamped in place with an attachment nut 42. The internal dimensions of the load driving carriage 36 are so chosen in relation to the dimensions of the cylinder that the same fits in the internal space 43 defined by the load driving carriage.

Figure 2:
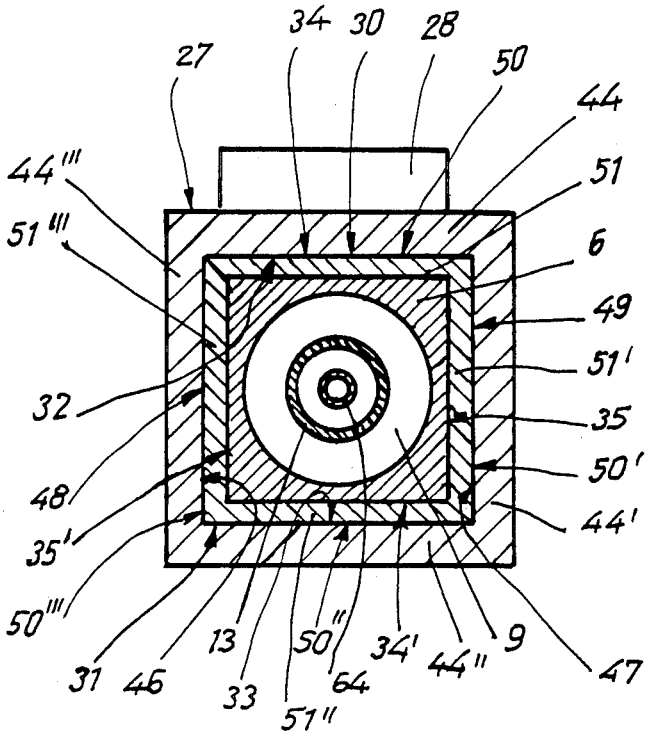
FIG. 2 is a cross section through the device of FIG. 1 taken on the line II—II.

The load driving carriage 36 has a square outline in cross section (see FIG. 2), the end wall 37 having the shape of a square plate while the carriage walls 44, 44', 44'' and 44''' form a box girder with a square cross section. The bearer surfaces 32 and 33 are constituted by the inwardly turned, inner sides of two opposite carriage walls 44 and 44'. In the longitudinal section of FIG. 1 the bearer surfaces 32 and 33 are therefore the facing inner sides of the two opposite limbs of the U.

It will be seen from what has been indicated so far that the load driving member is in the form of a square cross section, bell-like, load driving carriage so that in its longitudinal section it will have the form of a letter U. However it is not necessary that the load driving member have this form and it would in fact be possible for the load driving member to generally have the form of a letter U to a greater of lesser extent than shown here. The further account will however be on the assumption that the load driving carriage does in fact have the form of a letter U to the degree shown.

The length of the load driving carriage 36 as measured in the length direction of the load driving carriage 23 is approximately equal to the length of the cylinder including its end caps 7 and 8. This will ensure that when the piston rod is retracted into the cylinder 6, the latter will be practically completely within the interior 43 of the load driving carriage. In this retracted position the carriage walls 44 to 44''' will be radially opposite to, and fully overlapped with, the outer periphery of the cylinder 6 in relation to the longitudinal axis 25 so that the overall length of the advancing device in the retracted condition of the piston rod is approximately the same as the said length of the cylinder.

The already mentioned work carrying or mounting surface 27, on which a workpiece or the like may be affixed and which is generally flat, is provided on one of the two carriage walls 44 and 44'' having the bearer surfaces 32 and 33, that is to say on the outer side, opposite to the bearer surface 32, of the upper carriage wall 44. The mounting surface 27 is in this respect plane parallel to the bearer surface 32. Accordingly, in the lateral view of FIG. 1 and when the piston rod 13 is retracted, the mounting surface 27 will be approximately between the two cylinder end caps 7 and 8 and the associated guide surface. The weight of the workpiece 28 will therefore bear on the large area of the guide surface 30 adjacent to the driving surface so that a satisfactory guiding action is ensured. If the piston rod is moved outwards, the mounting surface 27 and the bearer surface 32 will move in relation to the guide surface 30 and accordingly in the protruding position of the piston rod 13 the weight of the work has to be carried. In order to take up the load in the protruding condition of the piston rod the opposite bearer surface 33 is provided, which is additionally supported on the associated guide surface 31 which is diametrally opposite to the first guide surface 30. Consequently there are no transverse forces acting on the piston rod and one may be certain of a low-wear operation of the advancing device 1. If there were no opposite surface 33 then the weight of the workpiece 28 would cause a bending moment on the piston rod 13, which might have an undesired effect thereon.

In order to provide for an optimum guiding effect whatever the position of the piston rod, the bearer surfaces 32 and 33 extend along the full length of the U-limbs or carriage walls 44 and 44', whose length is approximately the same as the length of the cylinder. Similarly the guide surfaces 30 and 31 have a length which is equal to the length of the cylinder. The result of this is a relatively large contact area between the bearer and guide surfaces whatever the position of the piston rod so that the specific surface pressure is low and a free-running displacement of the load driving carriage is possible in relation to the cylinder.

In the case of a further possible form of the invention, the length of the guide surfaces 30 and 31 is equal to the length of the cylinder, whereas the length of the bearer surfaces is less and they are formed in the carriage opening opposite to the end wall 37. Accordingly it would also be possible to have a still further design in which only the bearer surfaces would have a length equal to the length of the cylinder, whereas the guide surfaces would be provided adjacent to the cylinder end cap 8 with the piston rod running through it. In the case of these possible further forms of the invention there is no less satisfactory guiding action, although the individual surfaces may be produced more simply and at a lower price. These further possible constructions are not illustrated.

The bell-like form of the load driving carriage 36 offers the advantage that the cylinder is more or less completely surrounded and safeguarded to a degree related to the position of the piston rod. A still further advantage of this configuration is however the possibility of having flat abutment surfaces 46 and 47 extending in the length direction of the cylinder on the inner sides of the two upright carriage side walls 44' and 44''' wich are diametrally opposite and plane-parallel to each other; this is the case, as will be seen from FIG. 2, in the present working example. In this case the running surfaces 46 and 47 make running contact with diametrally opposite upright guide surfaces 48 and 49 on the outer surface of the cylinder so as to be complementary to each other. The running and lateral guide surfaces 46 to 49 are placed at a right angle to the guide and bearer surfaces 30 to 33. In a direction normal to the length direction 25 of the cylinder the bearer surfaces 32 and 33, together with the running surfaces 46 and 47, assume the shape of a square, within which the guide surfaces 30 and 31 and the lateral guide surfaces 48 and 49 are arranged also in complementary manner and in the form of a square. In other words the first-noted surfaces surround the second-noted surfaces coaxially and with a running fit or clearance.

In accordance with the invention, the advancing device is thus provided with a lateral guide means in addition to the guide on which the weight of the workpiece bears, and such lateral guide means assumes the function of providing an exact guiding action in addition to the piston rod. This is an advantage that more especially makes itself felt when the load driving carriage additionally has to withstand the effect of a lateral load, as will frequently be the case with machine tools.

In what follows an account will be given of the design of the outer face of the cylinder 6 which has the guide and lateral guide surfaces 30 and 31; 48 and 49. In the present working example of the invention, the cylinder 6 has a square outer cross section, whose four outer surfaces 34 and 34', 35 and 35' extending in the length direction 25 of the cylinder and being at a right angle to each other, are respectively arranged parallel to one of the guide surfaces 30 and 31 or the lateral surfaces 48 and 49. At the same time they however also extend parallel to the bearer and running surfaces 32 and 33; 46 and 47. In accordance with the invention the guide surfaces or the lateral guide surfaces are provided on the radially outwardly facing surfaces 50 to 50''' of liner plates 51 to 51''' provided between the outer surfaces of the cylinder 6 and the bearer or running surfaces 32, 33; 46 and 47, such liner plates 51 to 51''' not being able to twist in relation to the cylinder. The liner plates are therefore so placed that their one plate surface rests on one of the outer surfaces of the cylinder while the other respective plate surface rests on one of the running or bearer surfaces. In this respect the liner plates 51 to 51''' may be formed separately or with advantage, as is the case with the present working example, they may take the form of an integral sliding sleeve 52 in the form of a square box girder. The inner dimensions thereof are complementary to the radial outer dimensions of the cylinder 6 so that it fits coaxially onto the cylinder 6 with a twist-precluding locking effect, without any chance of its being able to be turned thereon. Its outer cross section is complementary to the inner cross section of the load driving member 36 so that it is furthermore surrounded by the latter with a locking action, in which respect there is still the possibility of its being able to slide in the longitudinal direction.

The sliding sleeve 52 may best be fixed in place by having the cylinder end caps 7 and 8 each provided with a radially projecting rim 53 and 53', which are respectively clamped on the axial shoulders of the sliding sleeve 52.

The use of liner plates or the above-mentioned sliding sleeve provides the opportunity to replace any parts that become worn so that there are then new guide surfaces without it being necessary to replace the cylinder itself. It is naturally possible to dispense with the guide sleeve or the like and to have the guide surfaces or lateral guide surfaces directly in the form of the outer surfaces 34 to 35' of a cylinder with a square outline in cross section (not illustrated). However in this respect the first-mentioned design gives the advantage of a more exact machining of the guide surfaces, inasmuch as the liner sleeve may be more simply manipulated.

In FIG. 1 the position of the load driving carriage and of the workpiece to be machined are indicated in broken lines at 54 and 54', respectively when the piston rod 13 is fully retracted, the cylinder 6 then being practically entirely within in the interior of the load driving carriage. Furthermore, the position of the load driving carriage and the workpiece when the piston rod is fully extended is marked at 55 and 55'. In this state the main guiding function is performed by the lower carriage wall 44'' diametrally opposite the carriage wall 44 carrying the workpiece.

As noted already the operation of the piston and cylinder arrangement is by way of a controller or operating device 26, which is connected via leads 56 with the connection orifices 57 and 58 leading to the working spaces 11 and 12 in the cylinder 6. In accordance with the invention, the two connection orifices 57 and 58 are provided in the cylinder end cap 7 that is remote from the piston rod 13. This makes it possible for the cylinder to move completely into the load driving carriage with a positive locking action preventing relative rotation.

The first one of the connection orifices 57 is connected via a first duct 62 directly with the working space remote from the piston rod 13. The connection between the second connection orifice 58 and the working space 12 with the piston rod extending through it is by way of a duct system to be explained.

The duct system has as its first part a straight duct 63, which is formed by a tube 64 that is coaxial in relation to the cylinder 6. This tube 64 is within a second duct 65 extending from the connection orifice 58 centrally through the cylinder end cap 7 and into the interior 10 of the cylinder 6. There is a seal between the tube 64 and the duct 65 and it has an open end adjacent to the opposite cylinder end cap 8. The part of the tube 64 in the interior of the cylinder extends at least in part into a socket 67 which has a larger diameter than the tube. The socket extends coaxially, like a blind hole, in the piston 9 and the piston rod 13, from the piston side 68 facing the cylinder end cap 7. On operation of the piston and cylinder arrangement the piston rod 13 and the piston 9 are moved in relation to the tube 64 in the longitudinal direction, the tube then extending to a greater or lesser extent into the socket 67, dependent on the position of the piston rod. The length of the socket 67 is at least as great as the length of the tube part 66 and is preferably made somewhat larger than it. There is a seal between the outer surface of the tube 64 and the inner surface of the socket 67, for which purpose there is a suitable packing adjacent to the piston 9, as for example one in the form of a shaft packing or an O-ring, which is attached to the piston 9 or to the piston rod 13 so as to surround the tube 64 with a sealing action thereon. The packing ring is indicated at 69. Towards the free end 18 and after the packing ring 69 the wall of the piston rod 13 has a transverse hole 70 therein, which forms a communication between the working space 12 and the socket 67.

The connection between the connection orifice 58 and the working space 12 is therefore via the duct 63, the socket 67 and the transverse hole 70.

The attachment of the tube 64 in the second duct 65 is best by crimping over the edge of the tube radially outwards while a connecting screw (not marked) is used to press the crimped edge against a sealing washer 71 and against a shoulder on a step in the duct 65. The connection screw means is preferably the nut used for connecting the lead or duct 56.

It is to be noted in addition that the transverse hole 70 is preferably arranged directly adjacent to the piston 9 in order to make it possible for a maximum extension of the piston rod 13. Possibly, as shown in FIG. 1, the right cylinder end cap 8 with the piston rod extending through it may have an annular recess 72, which ensures that the transverse hole 70 is in communication with the working space even when the piston 9 is right up against the cylinder end cap 8.

In keeping with a further embodiment of the invention the connection orifice 58, and the duct 65 joining with it, are arranged in the rim part of the cylinder end cap 7 and are connected via a duct which extends through the cylinder in its wall lengthways.

By way of conclusion it will be seen that the piston and cylinder arrangement of the invention practically constitutes not only a cylinder actuator but also a guide so that it is not necessary to have two separate units. At the same time the advancing device of the invention is very compact. Furthermore the construction of the guide surfaces prevents relative twisting without this however involving any changes to the piston or the piston rod. They may have a conventional round cross section and pistons or piston rods with an oval or quadrilateral cross section are not necessary. It is thus possible to make use of standard components so that the costs of the advancing device are low. Furthermore satisfactory and more especially exact guidance of the load driving member or of the load driving carriage is ensured because the guide surfaces and bearer surfaces have large areas.

What is claimed is:

1. In an advancing device with a fluid power piston and cylinder arrangement comprising a stationarily mounted cylinder whose two ends are closed by cylinder end caps, a piston arranged for motion in the longitudinal direction of the cylinder, a piston rod connected with the piston and extending sealingly through one of the end caps, a load driving member mounted on a section of the piston rod located outside the cylinder and adapted to perform a linear advancing motion on operation of the piston and cylinder arrangement, and a guide for guiding motion of the load, the improvement that said arrangement comprises means defining at least two guide surfaces which are located (generally) opposite and plane-parallel to each other on an outer periphery of the cylinder, extend in a longitudinal direction of the cylinder continuously for a distance equal to the linear travel of the load driving member and face away from each other, said guide surface defining means being fixed longitudinally and rotationally in relation to the cylinder, and the load driving member having at least two bearer faces located facing and opposite each other and directly in contact with and parallel to the respective guide surfaces, the respective bearer surfaces for the entire travel of the load driving member slidably and directly engaging (an) respective adjacent ones of said guide surfaces permitting sliding movement of the load driving member in the longitudinal direction of the cylinder, the guide surfaces and the bearer surfaces are configured for precluding rotational movement of the load driving member around the cylinder during the entire travel of the load driving member, the entire travel of the load driving member, the load driving member having a workpiece carrying face located opposite to the bearer surfaces and facing away from the cylinder for carrying a workpiece along the entire travel of the load driving member.

2. The device as claimed in claim 1 wherein the length of the load driving member as measured in the longitudinal direction of the cylinder is not greater than the length of the cylinder with its end caps, and, in a fully retracted condition of the piston rod, the driving means is generally opposite to and aligned with the outer periphery of the cylinder radially so that the length of the complete advancing device is approximately equal to the length of the cylinder.

3. The device claimed in claim 1 wherein (the) said workpiece carrying face is parallel to said opposite bearer surface, and is located between transverse planes containing the cylinder caps in a retracted condition of the piston rod and opposite to the associated guide surface.

4. The device as claimed in claim 1 wherein the load driving member is bell-shaped with the cylinder located coaxially therewithin and the two bearer surfaces are on opposite, facing, inner sides of walls of the bell.

5. The device as claimed in claim 1 wherein the load driving member comprises a bell-shaped load driving carriage with a square cross section and a carriage end wall centrally secured to the piston rod and the cylinder extending coaxially within the carriage the bearer surfaces being arranged on the inner sides of first and second mutually opposite walls of the carriage.

6. The device as claimed in claim 5 wherein on the inner sides of the relatively opposite third and fourth side walls of said carriage there are respective flat running surfaces extending in the length direction of the cylinder, such surfaces running on respective matching diametrically opposite lateral guide surfaces on the outer periphery of the cylinder the bearer surfaces extending at right angles to the running surfaces, and the guide surfaces being at right angles to the lateral guide surfaces.

7. The device as claimed in claim 6 wherein the bearer surfaces, the guide surfaces and the lateral guide surfaces are arranged to form a rectangular section taken transversely of the length direction of the surfaces and the length direction of the cylinder, and the bearer and running surfaces surround the guide and lateral guide surfaces coaxially and with a running fit.

8. The device as claimed in claim 5 wherein at least the bearer surfaces extend over the full-length of the walls of the load driving carriage, which is equal in length to the cylinder.

9. The device as claimed in claim 5 wherein the driving surface is provided on the side of one of the walls of the load driving carriage which is turned away from the cylinder.

10. The device as claimed in claim 1 wherein the guide surfaces and lateral guide surfaces are formed directly by side walls of the cylinder which has a cross-section rectangular in outline.

11. The device as claimed in claim 1 comprising four liner plates extending between said cylinder and said driving member, said liner plates being secured to said cylinder, opposite pairs of plates having, respectively, said guide side faces and lateral guide faces thereon for engagement by said bearer faces and side faces of said driving member respectively.

12. The device as claimed in claim 1 wherein the cylinder has a rectangular outline with respective ones of the four outer side faces being placed opposite respective ones of the bearer surfaces and running surfaces formed in said driving member.

13. The device as claimed in claim 12 comprising a liner sleeve of rectangular cross section keyed coaxially on said cylinder, said sleeve being surrounded by the load driving member so that it is coaxially keyed within it and is moveable longitudinally in relation thereto.

14. The device as claimed in claim 1 comprising means defining ducts extending from orifices at one end of said cylinder into two working spaces therein separated from each other by said piston.

15. The device as claimed in claim 14 wherein said duct system includes a tube extending from said end of said cylinder with said orifices thereat longitudinally and sealingly into a longitudinal passageway in said piston rod with a clearance between an outer face of said tube and the side of said passageway so that fluid may pass through one of said orifices, through said tube, through said clearance and through an opening leading radially from said clearance into one of said working spaces remote from said orifices.

16. The device as claimed in claim 15 wherein the lengths of the tube and passageway are respectively equal to and greater than the length of the cylinder, the extent to which the tube extends into the passageway depending on the position of the piston and the piston rod.

17. The device as claimed in claim 1 wherein said guide surface defining means forming a part of said cylinder.

* * * * *